United States Patent [19]

deVos et al.

[11] 3,986,019

[45] Oct. 12, 1976

[54] LIGHTING FIXTURE

[75] Inventors: Hendrik A. J. deVos; Elzear R. Labouliere, both of Swansea, Mass.

[73] Assignee: GTE Sylvania Incorporated, Stamford, Conn.

[22] Filed: May 1, 1975

[21] Appl. No.: 573,435

[52] U.S. Cl. ..... 240/147; 240/73 QD

[51] Int. Cl.[2] ..... F21V 17/00

[58] Field of Search ..... 240/25, 73 QD, 51.11 R, 240/73 LD, 147

[56] References Cited

UNITED STATES PATENTS

| | | | |
|---|---|---|---|
| 2,825,798 | 3/1958 | Ungone | 240/147 |
| 3,185,835 | 5/1968 | Muller | 240/147 |
| 3,210,538 | 10/1965 | Picha | 240/51.11 R |
| 3,464,727 | 9/1969 | Pascucci | 240/147 |
| 3,557,363 | 1/1971 | Bunte | 240/147 |
| 3,594,568 | 7/1971 | Guth | 240/51.11 R |
| 3,705,301 | 12/1972 | Franklin | 240/25 |
| 3,887,802 | 6/1975 | Goralnik | 240/147 |

*Primary Examiner*—L. T. Hix
*Assistant Examiner*—Vit W. Miska
*Attorney, Agent, or Firm*—Peter Xiarhos; Elmer J. Nealon; Norman J. O'Malley

[57] ABSTRACT

A lighting fixture adapted to be mounted to a support structure and wired with a minimum expenditure of time and labor. The lighting fixture includes an enclosure member defining a space for containing a power supply for the fixture, a support and wiring tray to which the power supply is mounted, a pair of hinge members jointly attached with the enclosure member and the support and wiring tray, and a cover and enclosure member removably attached to the hinge members by means of associated pairs of threaded bolts. In a typical installation procedure for the lighting fixture, the fixture is first mounted to a support structure by means of an attachment member secured to the cover and enclosure member, and one of the pairs of threaded bolts is removed from its associated hinge member to allow the remaining portion of the fixture to swing away and to hang suspended from the other pair of threaded bolts. As a result, the installer of the fixture has both hands free to perform the required wiring connections. After the required wiring connections have been completed, the suspended portion of the fixture is repositioned with respect to the cover and enclosure member to permit the previously removed pair of threaded bolts to be rethreaded into its associated hinge member.

To service the fixture, either pair of threaded bolts may be removed to permit the remaining portion of the fixture to swing away from the cover and enclosure member, thereby to provide access for the repairman to the wiring of the fixture and to allow the repairman to inspect, repair or replace one or more components of the fixture.

11 Claims, 10 Drawing Figures

LIGHTING FIXTURE

BACKGROUND OF THE INVENTION

The present invention relates to a lighting fixture and, more particularly, to a lighting fixture of rugged, compact design and capable of being installed and subsequently serviced with a minimum expenditure of time and labor.

In the installation of lighting fixtures, particularly lighting fixtures which are to be installed at substantial heights from ladders and scaffolding, it is generally desirable that workmen installing the lighting fixtures expend as little time and labor as possible in the mounting and wiring of the fixtures, thereby to minimize the possibility of the occurrence of accidents and to minimize installation costs. It is similarly desirable that any required subsequent servicing of the fixtures be accomplished with the least possible expenditure of time and labor. To accomplish the above objectives, lighting fixtures as discussed hereinabove should be of such design as to permit the rapid installation of the fixtures and to permit the use of simple and easily-implemented installation and servicing procedures. The present invention is directed to a lighting fixture which satisfies the above objectives.

BRIEF SUMMARY OF THE INVENTION

A lighting fixture in accordance with the present invention includes an enclosure member and power supply components for the lighting fixture. The enclosure member defines a space for containing the power supply components and has a bottom portion and first and second end portions extending upwardly from the opposite ends of the bottom portion, thereby to provide an open top and open sides for the enclosure member. First and second connection means are secured, respectively, to the first and second end portions of the enclosure member adjacent to the extremities of the first and second end portions, and a support tray extends across the open top of the enclosure member between the first and second connection means. A mounting means mounts at least one of the power supply components to the support tray so that the component suspends from the support tray into the space defined by the enclosure member.

The lighting fixture of the invention further includes a cover member having a top portion overlying the support tray and first and second opposed side portions extending from the top portion. The side portions of the cover member enclose the open sides of the enclosure member thereby enclosing the space defined by the enclosure member. First and second securing means releasably secure the cover member to the first and second connection means, respectively. The first securing means further pivotally secures the cover member to the first connection means, whereby when the cover member is released from the second connection means the rest of the fixture is able to pivot with respect to the first connection means. An attachment means is secured to the top portion of the cover member for mounting the lighting fixture to a support structure.

BRIEF DESCRIPTION OF THE DRAWING

Various objects, features and advantages of a lighting fixture in accordance with the present invention will be apparent from the following detailed discussion taken in conjunction with the accompanying drawing in which.

DETAILED DESCRIPTION OF THE INVENTION

Figure 1:
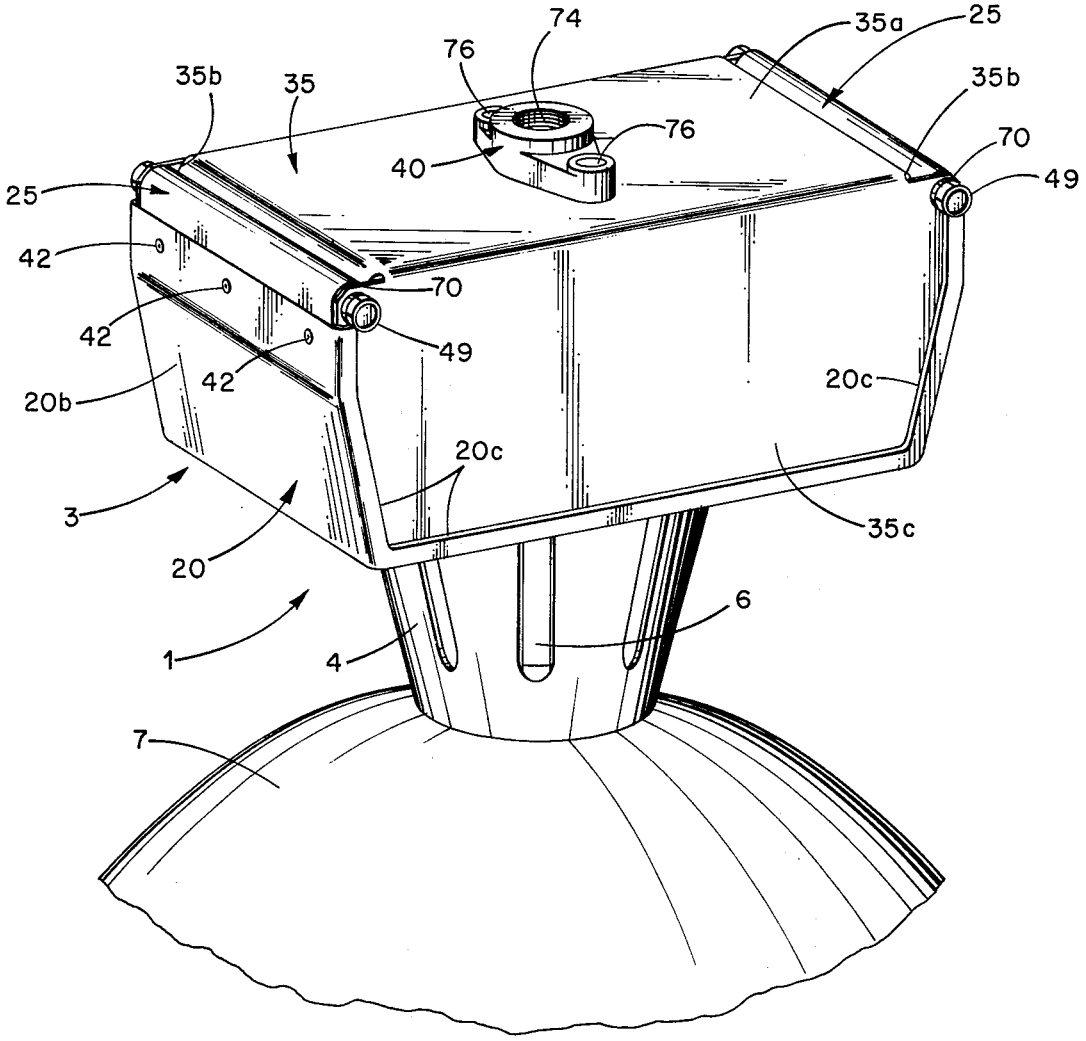
FIGS. 1–3 are perspective, side, and top views, respectively, of a lighting fixture in accordance with the present invention.
Figure 2:
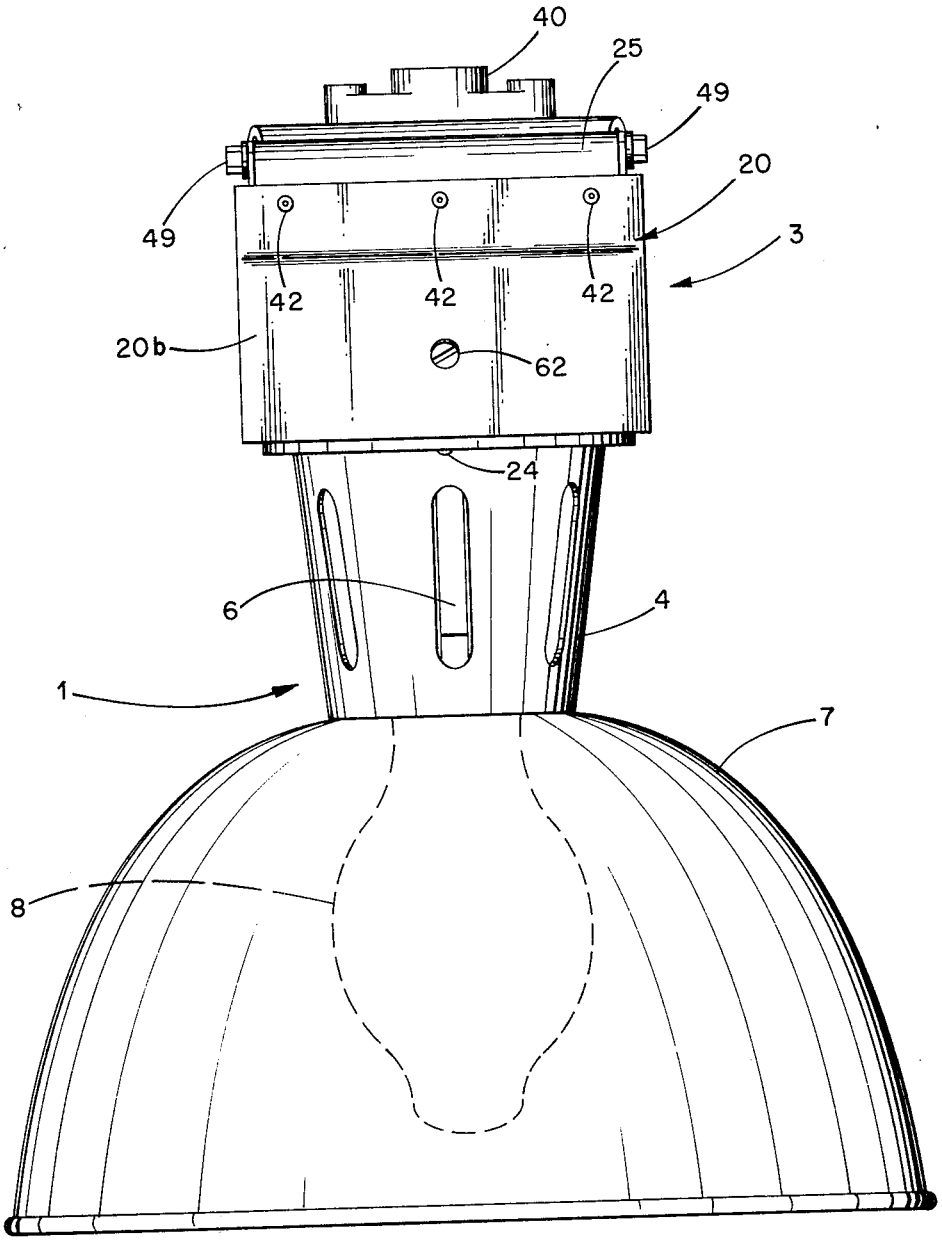
Figure 3:
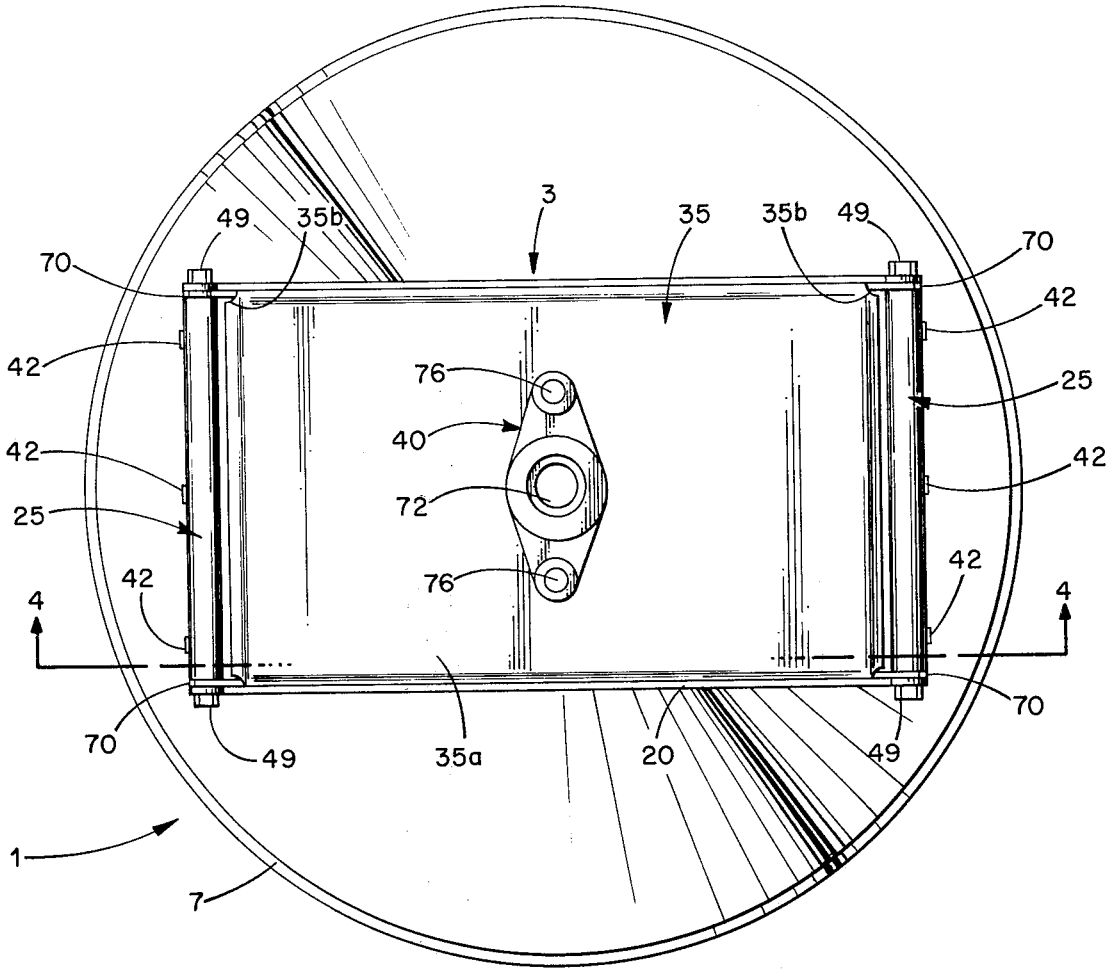

Referring now to FIGS. 1–4, there is shown a lighting fixture 1 in accordance with the present invention. As shown in these figures, the lighting fixture 1 generally comprises a housing assembly 3, a frame 4 attached to the housing assembly 3, a screw-type socket 6 disposed within the frame 4 and attached to the housing assembly 3, and a reflector 7 attached to the frame 4. The socket 6 is arranged to receive therein a lamp 8 (FIGS. 1 and 4) such as a high intensity discharge (HID) lamp as is well known in the lighting art.

Figure 4:
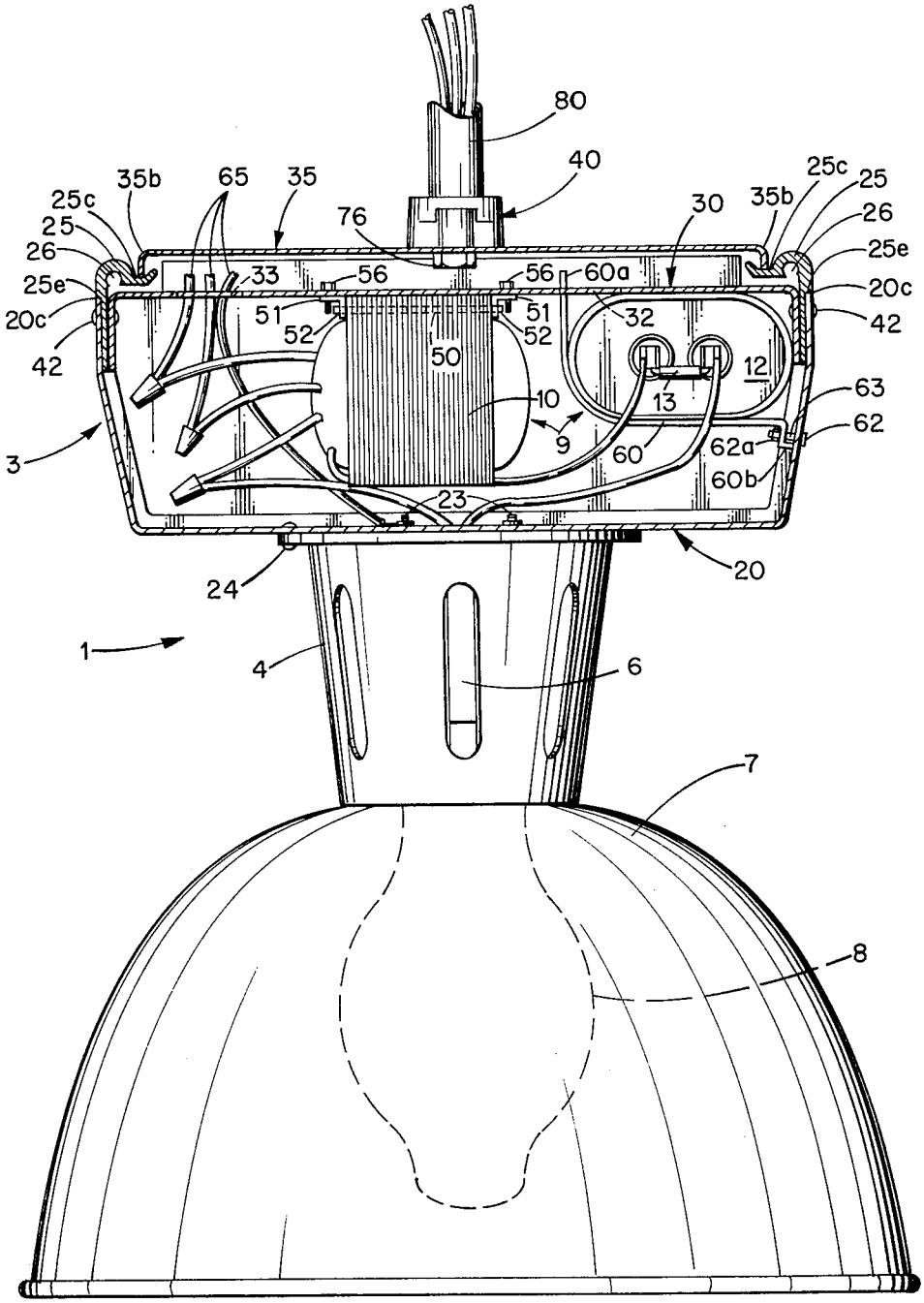
FIG. 4 is a view, partly in cross-section and as taken along the line 4—4 in FIG. 3, of the lighting fixture of the invention.
Figure 5:
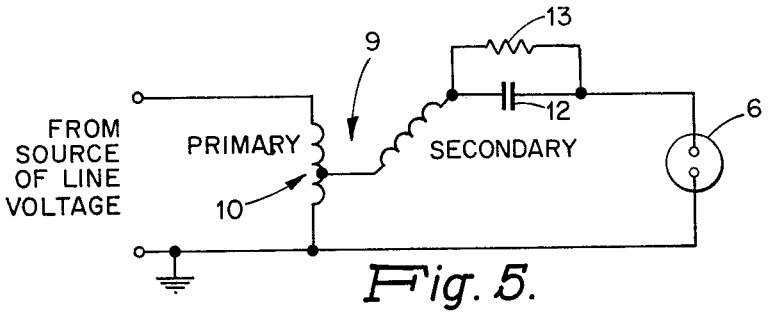
FIG. 5 is a schematic diagram illustrating the exemplary wiring arrangement for the electrical components of the lighting fixture of the invention.

The housing assembly 3, the principal components of which are shown individually in FIGS. 6–9, to be described in detail hereinafter, is employed in accordance with the invention to house the power supply for the fixture 1, the power supply being generally shown at 9 in FIG. 4. The power supply 9 as employed by the fixture 1 is of a conventional design and, as shown in FIG. 4, includes a ballast transformer 10, for example, of a constant-wattage autotransformer (CWA) type having primary and secondary windings, a capacitor 12 and a resistor 13. The ballast transformer 10, the capacitor 12 and resistor 13 are electrically interconnected with each other and also with a source of line voltage (not shown) and the socket 6 in a manner such as shown in the schematic wiring diagram of FIG. 5. The power supply 9 operates in a conventional fashion to provide a voltage for starting the lamp 8, to limit the electrical current to the lamp 8 and to sustain a minimum voltage to keep the lamp 8 from extinguishing.

The aforementioned frame 4, typically of metal, serves to space both the reflector 7 and the lamp 8 within the socket 6 from the housing assembly 3 so that the reflector 7 and the lamp 8 will not be adversely affected by heat normally produced and radiated outwardly by the power supply 9 contained within the housing assembly 3. The reflector 7, typically of a highly reflective metal, is used for its normal purpose of establishing a desired distribution pattern for the light emitted by the lamp 8.

Referring now to FIGS. 1–4 and 6–8, the aforementioned housing assembly 3 will be described in greater detail. As shown in these figures, the housing assembly 3 comprises a generally U-shaped enclosure member 20, shown in detail in FIG. 6; a pair of hinge members 25, each of which has the form shown in detail in FIG. 7; a support and wiring tray 30, shown in detail in FIG. 8; a cover and enclosure member 35, shown in detail in FIG. 9; and an attachment member 40. As shown in the aforesaid figures, and particularly FIG. 4, the enclosure member 20, the hinge members 25 and the support and wiring tray 30 are assembled together to form the major portion of the housing assembly 3. This assembly operation is accomplished in a simple fashion by riveting the three members together, specifically, by means of a plurality of rivets 42 (FIGS. 1–4) used in conjunction with openings 43 (FIG. 6) provided in the enclosure member 20, openings 44 (FIG. 7) provided in each of the hinge member 25, and openings 45 (FIG. 8) provided in the support and wiring tray 30. The cover and enclosure member 35 is removably attached to the aforesaid assembly in a simple manner by means of a plurality of threaded bolts 49 inserted through openings 48 (FIG. 9) in the cover and enclosure member 35 and threaded into opposite ends of the hinge members 25, as best indicated, for example, in FIGS. 1–3.

Figure 6:
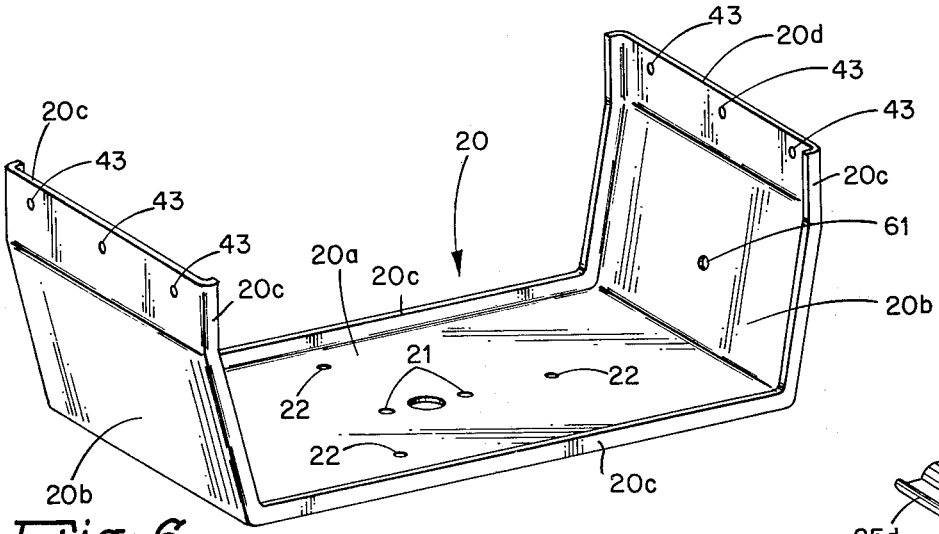
FIGS. 6–9 are perspective views of several components of a housing assembly of the lighting fixture of the invention, FIG. 8 being an exploded view.

The aforementioned enclosure member 20, typically of stamped metal, is employed in accordance with the invention to provide an enclosure or space for receiving and containing the aforedescribed power supply 9 as well as the wires and other parts, to be discussed hereinafter, employed in conjunction with the power supply 9. As shown in FIG. 6, the enclosure member 20 includes a flat bottom portion 20*a* and a pair of opposed end portions 20*b* integral with the bottom portion 20*a* and extending away angularly from the ends of the bottom portion 20*a*. The bottom and end portions 20*a* and 20*b* further have lips 20*c* formed at the side edges thereof for serving as guides for the cover and enclosure member 35 when the cover and enclosure member 35 has been positioned with respect to the enclosure member 20 to enclose the open sides of the enclosure member 20, as shown, for example, in FIG. 1. The enclosure member 20 also has two sets of openings 21 and 22 in the bottom portion 20*a* thereof for use in securing the socket 6 and the frame 4 to the enclosure member 20. More particularly, the openings 21 are used in conjunction with standard nut and bolt arrangements 23, as shown in FIG. 4, to secure the socket 6 to the enclosure member 20, and the openings 22 are used in conjunction with rivets 24, only one of which is visible in FIGS. 1 and 4, to secure the frame 4 to the enclosure member 20.

Figure 7:
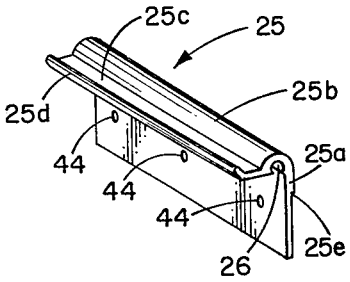

Each of the aforementioned hinge members 25, typically of extruded metal, includes, as shown in FIG. 7, a vertical portion 25*a*, an arcuate portion 25*b* integral with the vertical portion 25*a* and defining an elongated passageway 26 therealong, and a horizontal portion 25*c* integral with the arcuate portion 25*b* and having a lip 25*d* at the end thereof. The vertical portion 25*a* further has a step formed therein at 25*e*, this step being arranged, as indicated in FIG. 4, to engage an exposed edge surface 20*d* (FIG. 6) of a corresponding one of the end portions 20*b* of the enclosure member 20 at such time as the hinge member 25, the enclosure member 20, and the support and wiring tray 30 are to be secured together, as previously mentioned. The elongated passageway 26 of the arcuate portion 25*b* is arranged to receive, at opposite ends thereof, a pair of the aforementioned threaded bolts 48 for releasably securing the cover and enclosure member 35 to the hinge member 25. Although the passageway 26 is unthreaded, threads are formed in the hinge member 25 at opposite ends of the passageway 26 as the threaded bolts 48 are turned or screwed into the hinge member 25. The horizontal portion 25*c* of the hinge member 25 as shown in FIG. 7 is arranged to receive a gasket, if desired or necessary, to establish an air-tight fit between the cover and enclosure member 35 and the rest of the housing assembly 3, thereby to minimize the possibility of dust or other foreign matter entering the interior of the housing assembly 3. The lip 25*d* of the horizontal portion 25*c* assists in retaining the gasket in place.

Figure 8:
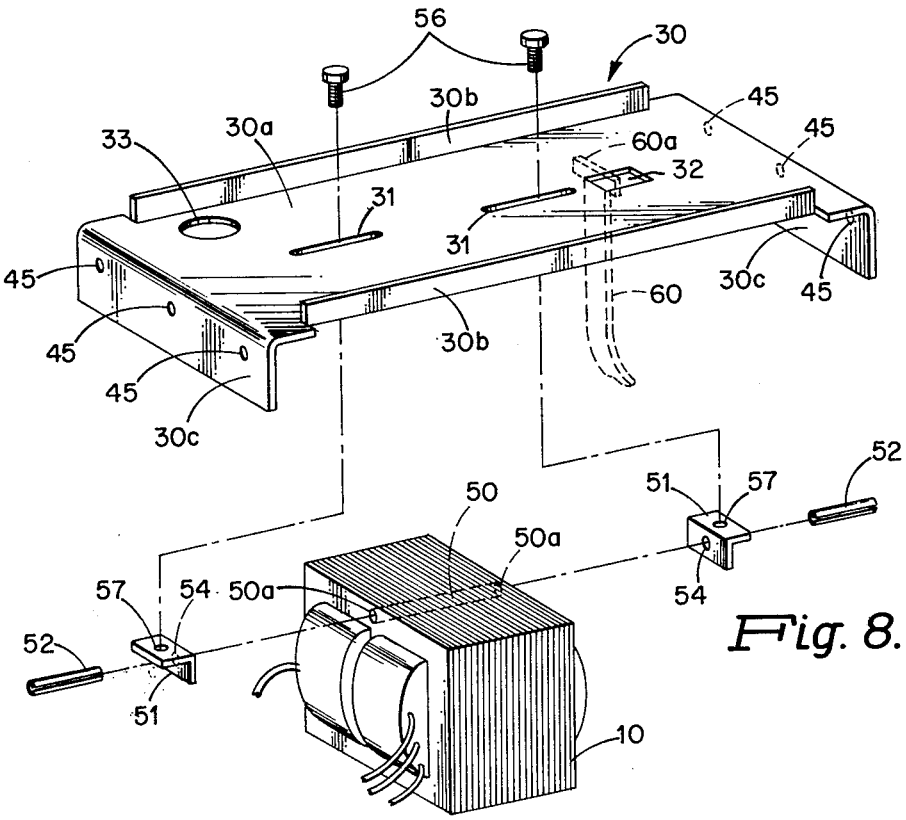

The manner in which the aforedescribed power supply 9 is physically arranged in the interior of the housing assembly 3 is shown by FIGS. 4 and 8. As shown in FIG. 4, the ballast transformer 10 is supported from the support and wiring tray 30 and the capacitor 12 is captured between the support and wiring tray 30 and the right end portion 20*b* of the enclosure member 20. As shown in FIG. 8, the support and wiring tray 30 includes a flat portion 30*a*, a pair of opposed retaining portions 30*b* integral with and normal to the top surface of the flat portion 30*a*, and a pair of opposed, generally L-shaped end portions 30*c* integral with the flat portion 30*a*. The flat portion 30*a* further has several openings therein including a pair of slotted openings 31, a rectangular opening 32 to the right of the slotted openings 31, and a circular opening 33 to the left of the slotted openings 31. The above-described support and wiring tray 30 is typically of stamped metal.

The slotted openings 31 in the support and wiring tray 30 are used in securing and suspending the ballast transformer 10, the width of which may be variable, from the support and wiring tray 30. More particularly, and as shown in FIG. 8, an opening 50 having opposite entrances 50*a* is provided through the metal core portion of the ballast transformer 10, and a pair of L-shaped brackets 51 are secured to the ballast transformer 10 by means of a pair of elongated, split, hollow mounting pins 52, commonly known as "rollpins," which are driven through openings 54 in the vertical portions of the L-shaped brackets 51 and into the entrances 50*a* of the opening 50 in the ballast transformer 10. The diameters of the openings 54 and of the split mounting pins 52 are selected so that the mounting pins 52 will become compressed when driven into the openings 54 and then tend to expand slightly once in the openings 54 to provide a tight fit therein. It is not necessary for the pins 52 to fit tightly within the opening 50. The lengths of the mounting pins 52 are selected so that the pins 52 will extend into the opening 50 by an amount sufficient to prevent the brackets 51 from falling away from the ballast transformer 10, however, for reasons to become apparent hereinafter, the pins 52 should not be so long as to lie in the paths of threaded openings 57 provided in the horizontal portions of the L-shaped brackets 51. Once the L-shaped brackets 51 have been mounted to the ballast transformer 10 as described hereinabove, a pair of threaded bolts 56 are inserted into the slotted openings 31 and threaded into the openings 57 in the L-shaped brackets 51. The threaded bolts 56 are selected to have a length so that the threaded portions thereof will extend past the exposed ends of the mounting pins 52 and be immediately adjacent thereto. As a result, the mounting pins 52 are "locked" positively in place and are prevented from being removed accidentally, for example, as a result of vibration, from the associated openings 50 and 54.

The above-described arrangement by which the ballast transformer 10 is mounted to the support and wiring tray 30 is also described, and claimed, in a copending application filed concurrently herewith in the name of Hendrik A. J. deVos, Ser. No. 573,434, entitled Ballast Transformer Mounting Arrangement, and assigned to the same assignee as the present application.

The aforementioned rectangular opening 32 in the support and wiring tray 30 is used for mounting the capacitor 12 within the housing assembly 3. As shown in FIGS. 4 and 8, a strap 60 having a generally T-shaped portion 60*a* at one end thereof and a generally L-shaped portion 60*b* at the other end thereof is arranged with respect to the opening 32 so that the T-shaped portion 60*a* is transverse to the narrow dimension of the opening 32 and abuts against the top surface of the portion 30*a* of the support and wiring tray 30. The strap 60 is then wrapped around the capacitor 12, as indicated in FIG. 4, and then secured to the right end portion 20*b* of the enclosure member 20 by means of a threaded bolt 62 which is inserted into an opening 61 (FIG. 6) in the right end portion 20*b* of the enclosure member 20 and then through an opening 63 in the L-shaped portion 60*b* and threaded into a nut 62*a*.

The aforementioned circular opening 33 in the support and wiring tray 30 is used for the passage of a plurality of wires 65 from within the space defined and enclosed by the members 20, 30 and 35 to a point above the support and wiring tray 30. The wires 65 are connected to leads from the aforedescribed power supply 9 and are used to establish electrical connections with wires external to the fixture 1, as will be discussed more fully hereinafter.

Figure 9:
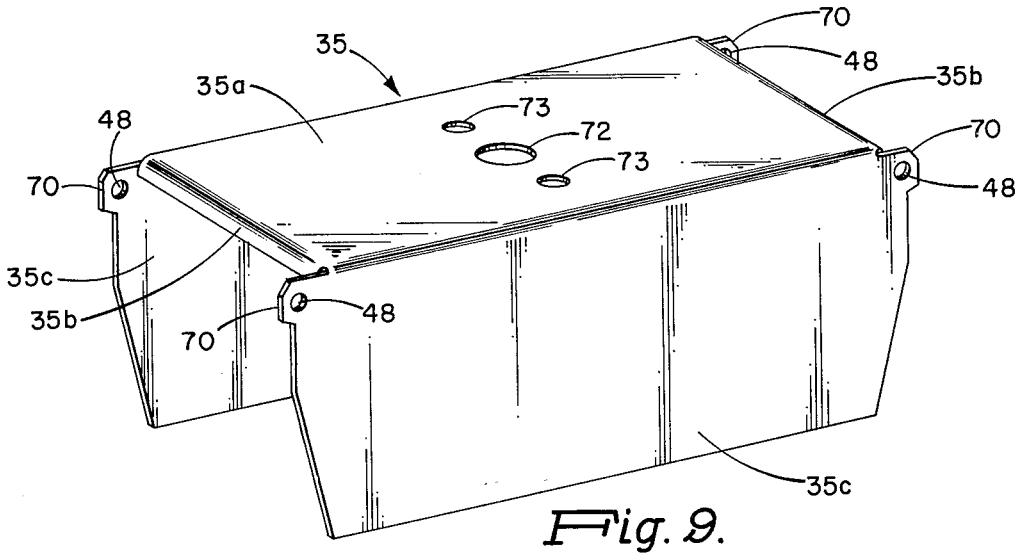

The cover and enclosure member 35 as shown in detail in FIG. 9 includes a top portion 35*a* having a pair of downwardly turned end portions 35*b*, as also shown in FIG. 4, and a pair of side portions 35*c* having tabs 70 in the corners thereof adjacent to the top portion 35*a*. The top portion 35*a* further has a circular opening 72 at the center thereof and a pair of openings 73 on opposite sides of the opening 72. The opening 72 is used in conjunction with a threaded opening 74 in the aforementioned attachment member 40 for the passage of wires external to the fixture 1 to the interior of the fixture 1 to be joined with the wires 65. The openings 73 are used in conjunction with a pair of threaded bolts 76 which are inserted into the openings 73 and threaded into corresponding threaded openings provided in the attachment member 40, as best shown, for example, in FIGS. 1 and 4. As mentioned previously, the cover and enclosure member 35 is attached to the hinge members 25 to enclose the open top and sides of the enclosure member 20. This operation is accomplished by means of the aforementioned bolts 49 inserted through the openings 48 in the tabs 70 and threaded into the hinge members 25. When the cover and enclosure member 35 is in its "closed" position as shown in FIGS. 1–4, the end portions 35*b* of the cover and enclosure member 35 abut against the horizontal portions 25*c* of the hinge members 25, thereby rendering the lighting fixture 1 air-tight and preventing dust or other foreign matter from entering the interior of the housing assembly. The cover and enclosure member 35 is typically of stamped metal.

Figure 10:
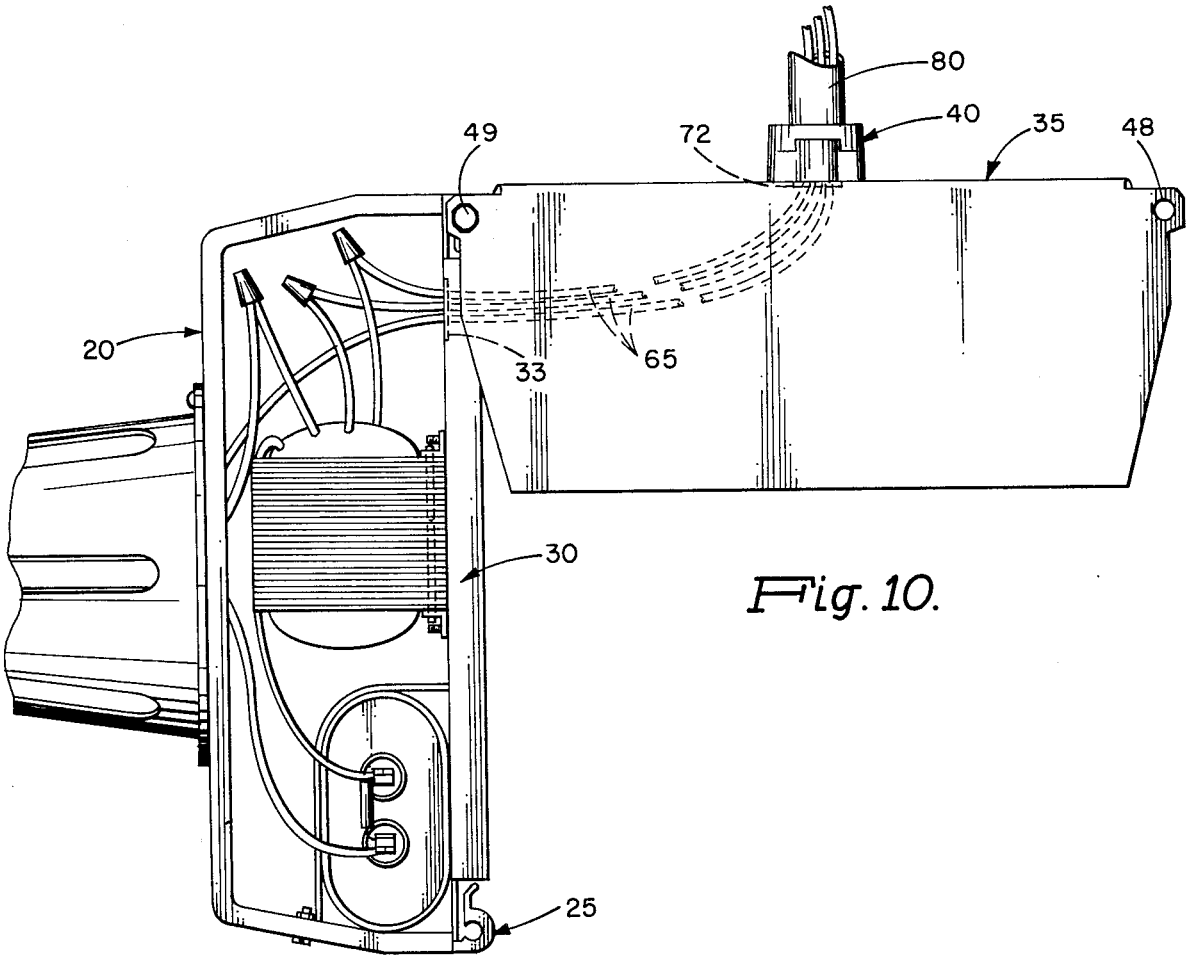
FIG. 10 is a view illustrating the lighting fixture of the invention as arranged in a position to be wired or serviced.

The mounting and wiring of the lighting fixture 1 as described hereinabove is accomplished in accordance with one possible installation sequence in the following manner. First, the lighting fixture 1, which has a typical weight of 12 pounds, is mounted to a support structure, such as an elongated pipe or conduit as shown at 80 in FIGS. 4 and 10, by threading the attachment member 40 onto a threaded end (not shown) of the pipe or conduit 80. One of the opposed pairs of threaded bolts 49, for example, the right-hand pair in the figures, is then removed from the associated hinge member 25 whereby the other hinge member 25 is able to rotate clockwise with respect to its associated bolts 49, causing the rest of the lighting fixture 1 to swing downwardly in a clockwise direction and away from the cover and enclosure member 35 and to hang suspended from the left-most pair of threaded bolts 49, as shown, for example, in FIG. 10. With the lighting fixture 1 in the position as shown in FIG. 10, the installer of the fixture has both hands free and is able easily to perform the necessary wiring operations. Specifically, the wires external to the fixture 1 are able to be passed down through the pipe or conduit 80 and through the opening 72 in the cover and enclosure member 35 and to be joined with the wires 65 exiting from the circular opening 33 in the support and wiring tray 30. It will be noted, particularly from FIG. 8, that the presence of the retaining portions 30*b* of the support and wiring tray 30 causes the wiring connections to be contained on the support and wiring tray 30 so that they will not interfere with the proper operation of the cover and enclosure member 35 in moving between its open and closed positions.

Once the appropriate wiring connections have been made, the suspended portion of the lighting fixture 1 is repositioned with respect to the cover and enclosure member 35 so that the previously-removed pair of bolts 49 (that is, the right-hand pair) may be rethreaded into its associated hinge member 25. The installation of the lighting fixture 1 is, at this point, complete.

As an alternative installation sequence to that described hereinabove, the cover and enclosure member 35 may first be completely removed from the rest of the fixture 1, specifically, by removing both the right-hand and left-hand pair of bolts 49, and the cover and enclosure member 35 then attached to the pipe 80 by means of the attachment member 40. Wires external to the fixture 1 may then be passed through the pipe or conduit 80 and, after the previously removed portion of the fixture 1 has been attached to one of the hinge members 25, joined with the wires internal to the fixture 1.

The servicing of the lighting fixture 1, either to gain access to the wiring connections or to inspect, repair or replace one or more of the components of the fixture, is also easily accomplished. It is only necessary to remove one of the pairs of bolts 49 (either the right-hand pair or the left-hand pair) so that the main portion of the fixture is able, in the manner previously described, to fall away from the cover and enclosure member 35 and to hang suspended from the other pair of bolts 49. As a result, the repairman is provided rapid access to the electrical wiring connections located in the region between the cover and enclosure member 35 and the support and wiring tray 30 and also to the components housed within the enclosure member 20, as indicated in FIG. 10. If it is desired to remove the suspended portion of the lighting fixture 1, for example, to be repaired or replaced with a similar unit, it is only necessary to remove the other pair of bolts 49 whereby the suspended portion is able to fall away completely from the cover and enclosure member 35.

While there has been described what is considered a preferred embodiment of the invention, it will be obvious that various changes and modifications may be made therein without departing from the invention as called for in the appended claims.

What is claimed is:

1. A lighting fixture, comprising:

power supply components for the lighting fixture;

an enclosure member defining a space for containing the power supply components for the lighting fixture, said enclosure member having a bottom portion and first and second end portions extending upwardly from the opposite ends of the bottom portion thereby to provide an open top and open sides for the enclosure member;

first and second connection means secured, respectively, to the first and second end portions of the enclosure member adjacent to the extremities of the first and second end portions;

a support tray extending across the open top of the enclosure member between the first and second connection means;

mounting means mounting at least one of the power supply components to the support tray so that said at least one component suspends from the support tray into the space defined by the enclosure member;

a cover member having a top portion overlying the support tray and first and second opposed side portions extending from the top portion and enclosing the open sides of the enclosure member thereby enclosing the space defined by the enclosure member;

first and second securing means releasably securing the cover member to the first and second connection means, respectively, said first securing means further pivotally securing the cover member to the first connection means, whereby when the cover member is released from the second connection means the rest of the fixture, including the enclosure member, the second connection means, the mounting means, and the support tray and the at least one power supply component mounted thereto, is able to pivot with respect to the first connection means; and attachment means secured to the top portion of the cover member for mounting the lighting fixture to a support structure.

2. A lighting fixture, comprising:

power supply components for the lighting fixture;

an enclosure member defining a space for containing the power supply components for the lighting fixture, said enclosure member having a bottom portion and first and second end portions extending upwardly from the ends of the bottom portion thereby to provide an open top and open sides for the enclosure member;

first and second hinge means secured, respectively, to the first and second end portions of the enclosure member adjacent to the extremities of the first and second end portions;

a support tray extending across the open top of the enclosure member between the first and second hinge means;

mounting means mounting at least one of the power supply components to the support tray so that said at least one component suspends from the support tray into the space defined by the enclosure member;

a cover member having a top portion overlying the support tray and first and second opposed side portions extending from the top portion and enclosing the open sides of the enclosure member thereby enclosing the space defined by the enclosure member;

securing means releasably securing the cover member to the first and second hinge means, whereby when the cover member is released from either one of the hinge means the rest of the fixture, including the enclosure member, one of the hinge means, the mounting means, and the support tray and the at least one of the power supply components mounted thereto, is able to pivot with respect to the other hinge means; and attachment means secured to the top portion of the cover member for mounting the lighting fixture to a support structure.

3. A lighting fixture in accordance with claim 2 including:

means securing the enclosure member, the first and second hinge means and the support tray together.

4. A lighting fixture in accordance with claim 2, further comprising:

a frame assembly secured to the enclosure member at the outer surface of the bottom portion of the enclosure member;

a lamp socket secured to the enclosure member at the outer surface of the bottom portion of the enclosure member and disposed within the frame assembly, said lamp socket being adapted to receive a light-emitting lamp; and a reflector secured to the frame assembly for establishing a predetermined distribution pattern of light emitted by a lamp within the lamp socket.

5. A lighting fixture in accordance with claim 2 wherein:

each of the first and second hinge means includes an arcuate portion along a predetermined portion of the width of the associated end portion of the enclosure member and defining a passageway of essentially circular cross-section;

each of the opposed side portions of the cover member has openings therein coaxial with the passageways defined by the arcuate portions of the first and second hinge means; and the securing means includes threaded fasteners inserted into the openings in the side portions of the cover member and threaded into the passageways defined by the arcuate portions of the first and second hinge means.

6. A lighting fixture in accordance with claim 2 wherein:

the power supply components contained in the space defined by the enclosure member have electrical wires associated therewith internally within the enclosure member to be connected with electrical wires external to the fixture; and the support tray has an opening therein for the passage of the internal electrical wires from within the enclosure member to a region above the support tray to be joined, when the cover material is released from either one of the hinge means, with electrical wires external to the fixture.

7. A lighting fixture in accordance with claim 2 including:

means securing the enclosure member, the first and second hinge means and the support tray together; and wherein:

each of the first and second hinge means includes an arcuate portion disposed along a predetermined portion of the width of the associated end portion of the enclosure member and defining a passageway of essentially circular cross-section;

each of the opposed side portions of the cover members has openings therein coaxial with the passageways defined by the arcuate portions of the first and second hinge means; and the securing means releasably securing the cover member to the first and second hinge means includes threaded fasteners inserted into the openings in the opposed side portions of the cover member and threaded into the passageways defined by the arcuate portions of the first and second hinge means.

8. A lighting fixture in accordance with claim 6 wherein:

the cover member has an opening in the top portion thereof for the passage into the region above the support tray of electrical wires external to the fixture to be joined with the internal wires in said region when the cover member has been released from one of the hinge means;

the support tray and the top portion of the cover member are spaced apart from each other by a predetermined distance when the cover member is secured to both hinge means to establish a space for receiving and retaining electrical connections made between the internal electrical wires and electrical wires external to the fixture; and the support tray includes confinement means extending upwardly from the support tray for confining the aforesaid electrical connections to the aforesaid space established between the top portion of the cover member and the support tray.

9. A lighting fixture in accordance with claim 7 further comprising:

a frame assembly secured to the enclosure member at the outer surface of the bottom portion of the enclosure member;

a lamp socket secured to the enclosure member at the outer surface of the bottom portion of the enclosure member and disposed within the frame assembly, said lamp socket being adapted to receive a light-emitting lamp; and a reflector secured to the frame assembly for establishing a predetermined distribution pattern of light emitted by a lamp within the lamp socket.

10. A lighting fixture in accordance with claim 9 wherein:

the power supply components contained in the space defined by the enclosure member have associated therewith electrical wires internally within the enclosure member to be connected with electrical wires external to the fixture;

the support tray has an opening therein for the passage of the internal electrical wires from the enclosure member to a region above the support tray to be joined, when the cover member is released from either one of the hinge means, with electrical wires external to the fixture.

11. A lighting fixture in accordance with claim 10 wherein:

the cover member has an opening in the top portion thereof for the passage into the region above the support tray of electrical wires external to the fixture to be joined with the internal wires in said region when the cover member has been released from one of the hinge means;

the support tray and the top portion of the cover member are spaced apart from each other by a predetermined distance when the cover member is secured to both hinge means to establish a space for receiving and retaining electrical connections made between the internal electrical wires and electrical wires external to the fixture; and the support tray includes confinement means extending upwardly from the support tray for confining the aforesaid electrical connections to the aforesaid space established between the top portion of the cover and the support tray.

* * * * *